US006170247B1

(12) United States Patent
Ragnoli et al.

(10) Patent No.: US 6,170,247 B1
(45) Date of Patent: Jan. 9, 2001

(54) DEVICE FOR PREPARING A THREAD END FOR SPLICING WITH AN APPARATUS FOR THE KNOTLESS PNEUMATIC SPLICING OF TEXTILE THREADS AND YARNS

(75) Inventors: Fabrizio Ragnoli; Ruggero Veronese, both of Salo' (IT)

(73) Assignee: Mesdan S.P.A., Brescia (IT)

( * ) Notice: Under 35 U.S.C. 154(b), the term of this patent shall be extended for 0 days.

(21) Appl. No.: 09/283,926

(22) Filed: Apr. 1, 1999

(30) Foreign Application Priority Data

Apr. 2, 1998 (IT) ..... MI98A0706

(51) Int. Cl.[7] ..... D01H 3/36
(52) U.S. Cl. ..... 57/22; 57/23
(58) Field of Search ..... 57/22, 23, 350; 19/144; 28/254, 271, 272

(56) References Cited

U.S. PATENT DOCUMENTS

| | | | | |
|---|---|---|---|---|
| 4,411,128 | | 10/1983 | Mima . | |
| 4,439,978 | | 4/1984 | Mima . | |
| 4,446,687 | | 5/1984 | Mima . | |
| 4,494,366 | | 1/1985 | Deno . | |
| 4,497,165 | * | 2/1985 | Vollm | 57/22 |
| 4,499,715 | * | 2/1985 | Chardon et al. | 57/22 |
| 4,549,392 | | 10/1985 | Kimura . | |
| 4,671,053 | * | 6/1987 | Mima | 57/22 |
| 4,829,759 | | 5/1989 | Cottenceau et al. . | |
| 4,890,451 | | 1/1990 | Cottenceau et al. . | |
| 5,155,987 | * | 10/1992 | Vogel | 57/22 |
| 5,175,983 | | 1/1993 | Artzt et al. . | |
| 5,319,914 | * | 6/1994 | Premi | 57/22 |
| 5,406,781 | | 4/1995 | Yokoya . | |

* cited by examiner

*Primary Examiner*—John J. Calvert
*Assistant Examiner*—Gary L. Welch
(74) *Attorney, Agent, or Firm*—Kramer, Levin, Naftalis & Frankel LLP

(57) ABSTRACT

A device for preparing a thread end for splicing with an apparatus for the knotless pneumatic splicing of textile threads and yarns comprises a small tube for treating the thread end which is open at its opposite ends and suitable for receiving the end of the thread to be treated in correspondence with a peripheral point of its inlet end, and, at a distance from and opposite the said inlet end of the small tube, a circular nozzle for blowing a jet of pressurized fluid which is aligned with the said small tube and may be connected to a source of compressed fluid, the said nozzle having the end from which the jet of fluid emerges cut obliquely with respect to its axis so as to form an elliptical aperture and being mounted in rotatably adjustable manner about its axis with the elliptical outlet aperture of the jet of fluid facing towards the peripheral point of the inlet end of the small tube in correspondence with which the latter receives the thread end to be treated.

5 Claims, 5 Drawing Sheets

Figure 1:
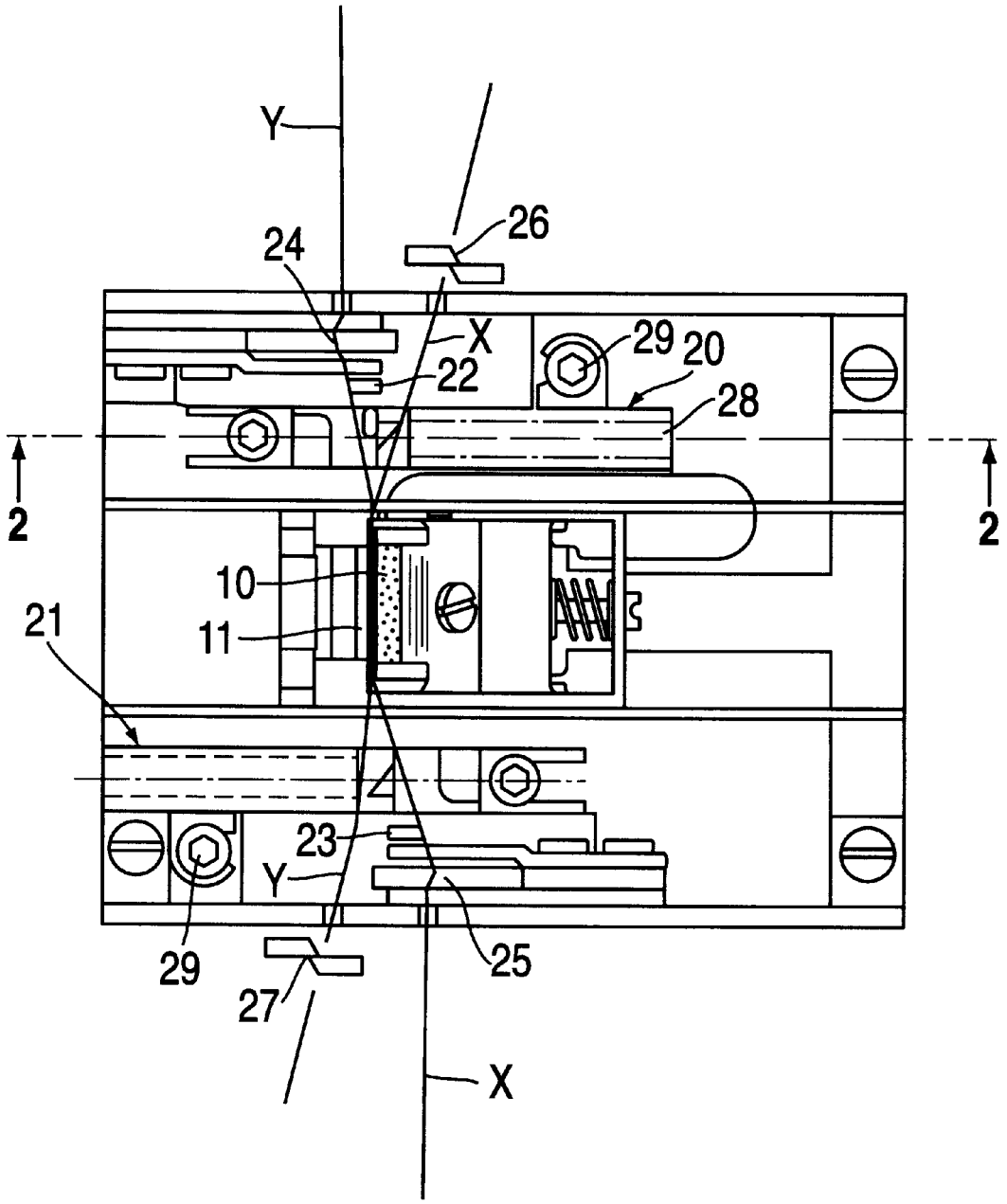

DEVICE FOR PREPARING A THREAD END FOR SPLICING WITH AN APPARATUS FOR THE KNOTLESS PNEUMATIC SPLICING OF TEXTILE THREADS AND YARNS

The present invention relates to a device for preparing the end of a thread to be spliced with an apparatus for the knotless pneumatic splicing of textile threads and yarns.

As is known, apparatus of this kind, commonly called "splicers", comprise a small splicing chamber in which the knotless splicing of the ends of the two threads to be spliced takes place under the effect of a compressed fluid, normally air, introduced in the form of a jet through a nozzle.

These apparatus also usually provide devices for preparing or pre-treating the ends of the two threads to be spliced. In fact it is well known in the trade that to obtain a good join of the ends of the threads by splicing it is necessary to provide for accurate preparation by means of a pre-treatment of the ends of the said threads so as to eliminate the twist in them over a certain length and parallelize their fibers.

According to the prior art this pre-treatment takes place in various types of devices usually mounted on the pneumatic splicing apparatus.

For each thread to be spliced a known device of this type (U.S. Pat. No. 4,494,366) comprises a small tube which is mounted laterally with respect to the splicing chamber with its axis perpendicular to the plane in which the threads reach the splicing chamber and is passed through axially by a stream of pressurized fluid created by suction and/or intake of compressed fluid in a direction which is oblique with respect to the axis of the tube, into which tube the end of the thread to be pre-treated is inserted by means of the vacuum created at the inlet of the tube by the stream of pressurized fluid, to then undergo untwisting and parallelizing of the fibers on the part of the compressed fluid introduced in oblique direction. In this type of device problems may arise in inserting the thread end into the tube, particularly in the case of rigid or highly twisted yarns, as a result of insufficient vacuum at the tube inlet. A further problem which is encountered in the known device is that in order to obtain a good preparation of the ends, of the threads to be spliced it is necessary for the duration of treatment to be rather long, thus also prolonging the overall splicing time.

Other types of devices (German patent 3.804.648 or U.S. Pat. Nos. 4,829,759 and 4,890,451) have therefore been proposed, which still provide a small tube passed through axially by a stream of pressurized fluid and in which is inserted longitudinally a flexible plate locked at one end and free to oscillate at its other end under the effect of a pressurized fluid introduced in an oblique direction with respect to the axis of the tube.

In this case the end of the thread to be pre-treated and inserted into the tube is beaten by the vibrating free end of the flexible plate which facilitates and improves the untwisting and parallelizing of the fibers.

Although this device provides optimum pre-treatment results for all types of threads and yarns, including those which are highly resistant to untwisting, it has the disadvantage of comprising a moving component (the flexible plate) which is subject to fatigue and ageing phenomena over time and thus requires maintenance and replacement with some frequency.

Further known devices for pre-treating a thread end for knotless pneumatic splicing (German patent 38.28.319 or U.S. Pat. No. 5,175,983) still comprises a small tube intended to receive the thread end to be prepared, opposite which tube and axially at a distance in correspondence with one of its inlet ends for the end of the thread to be prepared is a nozzle for blowing a jet of pressurized fluid, while the internal surface of the small tube is rendered at least partially rough, so that the thread end introduced into the small tube is beaten against the said rough surface for a certain amount of time by the turbulent stream of fluid passing through the tube and thus undergoes the desired untwisting and parallelization of the fibers which make up the thread end. This type of device chiefly lends itself to the preparation of yarns with an irregular and non-traditional twist, of the open-end type of yarns and further comprises the risk of the fibers of the treated yarn being damaged by sharp edges on the rough surface of the small tube against which the end of the thread is repeatedly beaten. A device of this kind does not guarantee good pre-treatment results of yarns obtained by the traditional ring spinning methods and having a more or less strong S or Z intrinsic twist. In fact, to untwist such yarns, the stream of fluid acting on their end must be directed obliquely in the direction opposite to the intrinsic twist of the said yarn, otherwise, instead of causing them to untwist it would cause the intrinsic twist to increase. Therefore, for yarns with different twists, the direction of the stream of fluid used for untwisting should also be selected in a different manner from time to time.

The object of the present invention is to provide, for an apparatus for the knotless pneumatic splicing of textile threads or yarns, a device for preparing the thread end for splicing which-guarantees an optimum and reliable pre-treatment of the thread end in a reduced time so as not to impact excessively on the total time of the splicing operation, which may be used for all the various types of yarns to be treated, regardless of the direction of their intrinsic twist and of the fact that the twist is more or less strong, and which does not require any maintenance/replacement of component parts. Furthermore, the preparation device should permit a reliable capture of the thread end to be treated and rule out any risk of the thread reaching the pneumatic splicing operation without having undergone the necessary pre-treatment of its end or of the capture of the thread end requiring too long a time so as to reduce the time available for the preparation operation proper.

In view of this object, for an apparatus for the pneumatic splicing of textile threads and yarns having a small splicing chamber the invention proposes a device for preparing a thread end for splicing comprising a small treatment tube which is open at its opposite ends and suitable for receiving the end of the thread to be treated in correspondence with a peripheral point of its inlet end, and, at a distance from and opposite the said inlet end of the small tube, a circular nozzle for blowing a jet of pressurized fluid which is axially aligned with the said small tube and connected by means of a shut-off element to a source of pressurized fluid, characterized in that the end from which the jet of fluid emerges from the said nozzle is cut obliquely with respect to the axis of the nozzle so as to form an elliptical aperture, that the nozzle is mounted in rotatably adjustable manner about its own axis and that the nozzle's elliptical outlet aperture faces towards the peripheral point of the inlet end of the small tube in correspondence with which the latter receives the thread to be treated.

The invention is based on the observation that the jet of a pressurized fluid emerging from an aperture cut obliquely to the axis of a nozzle undergoes a diversion of its axis with respect to the axis of the nozzle so that when the diverted jet enters the small treatment tube axially aligned with the nozzle, the jet acts not centrally but in decentralized manner in the tube with the result that it causes the thread end inside the tube to untwist. If the nozzle is orientated about its own axis so that the major axis of its elliptical outlet aperture is in the plane passing through the axis of the tube and through the peripheral point of its inlet end in correspondence with which it receives the thread end to be treated, the nozzle is in a neutral position and the preparation device has no preference between treatment of yarns with an S-twist and yarns with a Z-twist. By rotating the nozzle by a certain angle about its own axis in one direction or the other it is possible to incline the major axis of the nozzle's elliptical outlet aperture with respect to the said plane and in this way the preparation device may be easily adapted to produce an untwisting effect which is distinctly preferred for yarns having S-twist or Z-twist respectively.

A device for preparing a thread end for knotless pneumatic splicing as proposed according to the invention does not only guarantee an optimum, reliable and rapid preparation of a thread end with a perfect untwisting and parallelization of the fibers thanks to the action of the diverted jet of fluid inside the small treatment tube, an action which may easily be adapted to the specific demands of S yarns and Z yarns with a simple rotation and orientation of the nozzle about its own axis, but this device also ensures, with no possibility of errors, the accurate capture of the thread end and its introduction into the treatment tube which is equipped neither with moving parts which require constant maintenance nor with rough surfaces which may damage the integrity of the fibers of the yarn.

Figure 2:
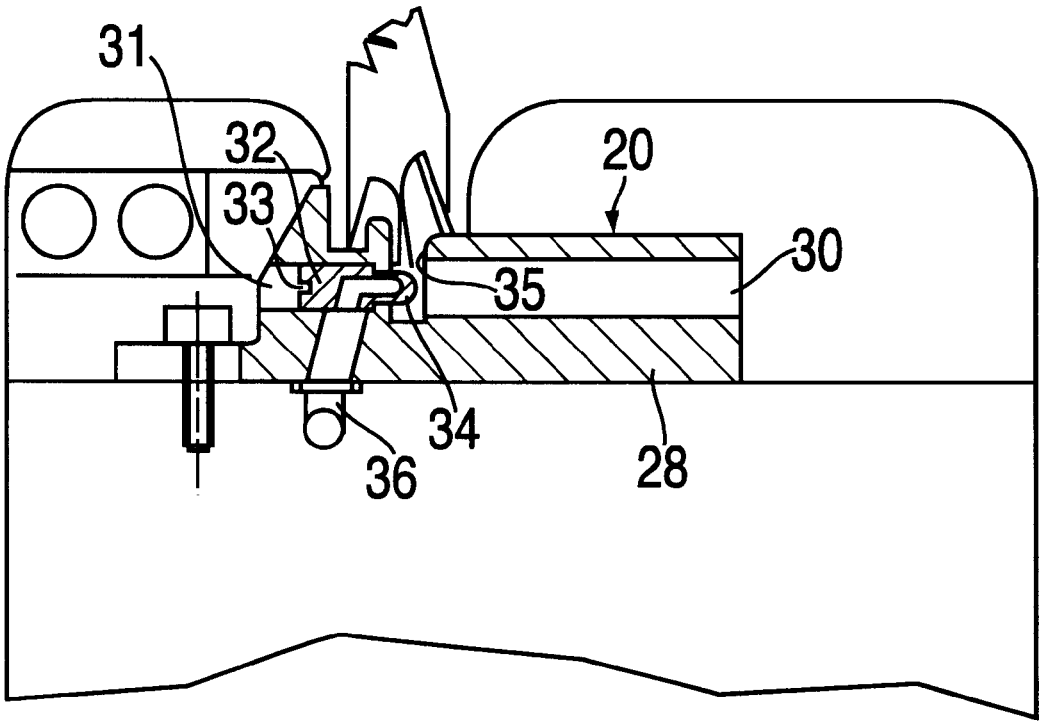
Figure 3:
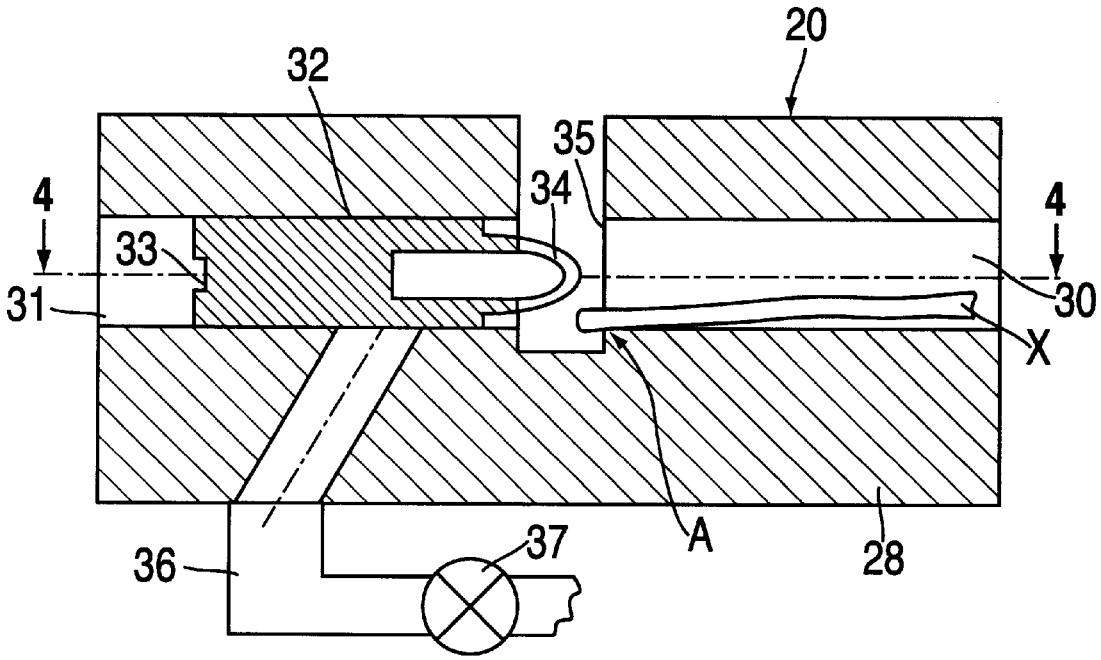
Figure 4:
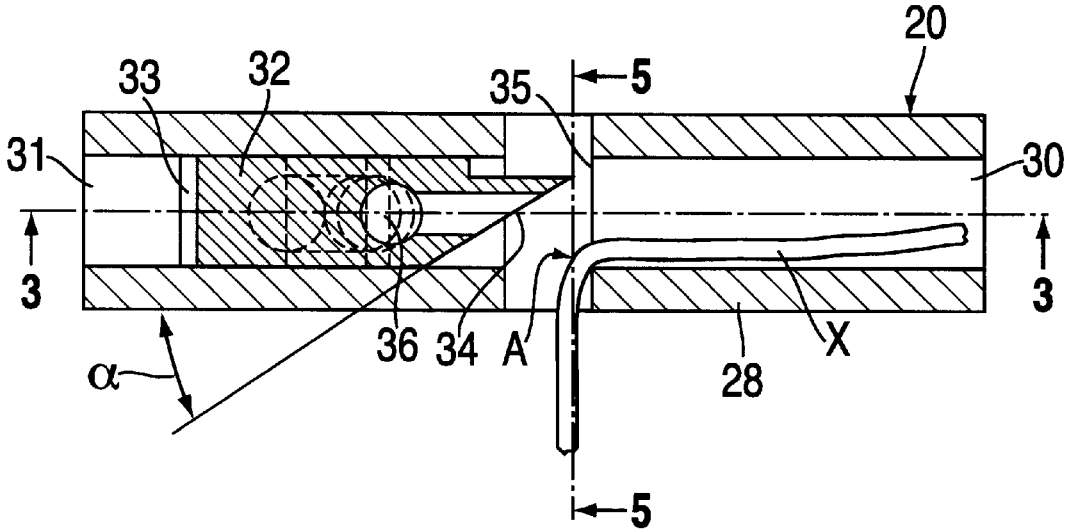
Figure 5B:
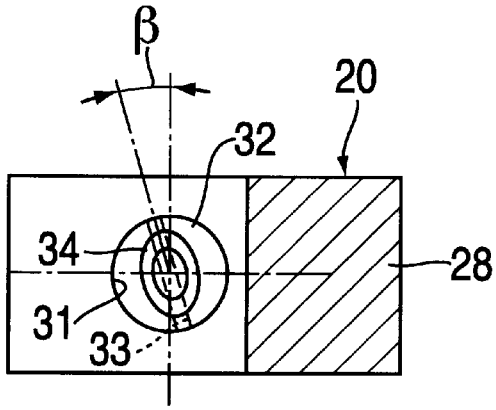
Figure 5A:
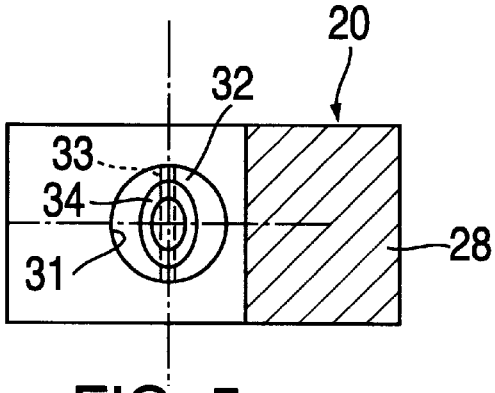
Figure 5C:
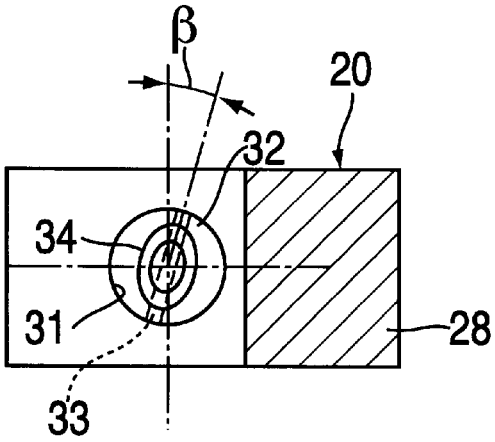
Figure 6:
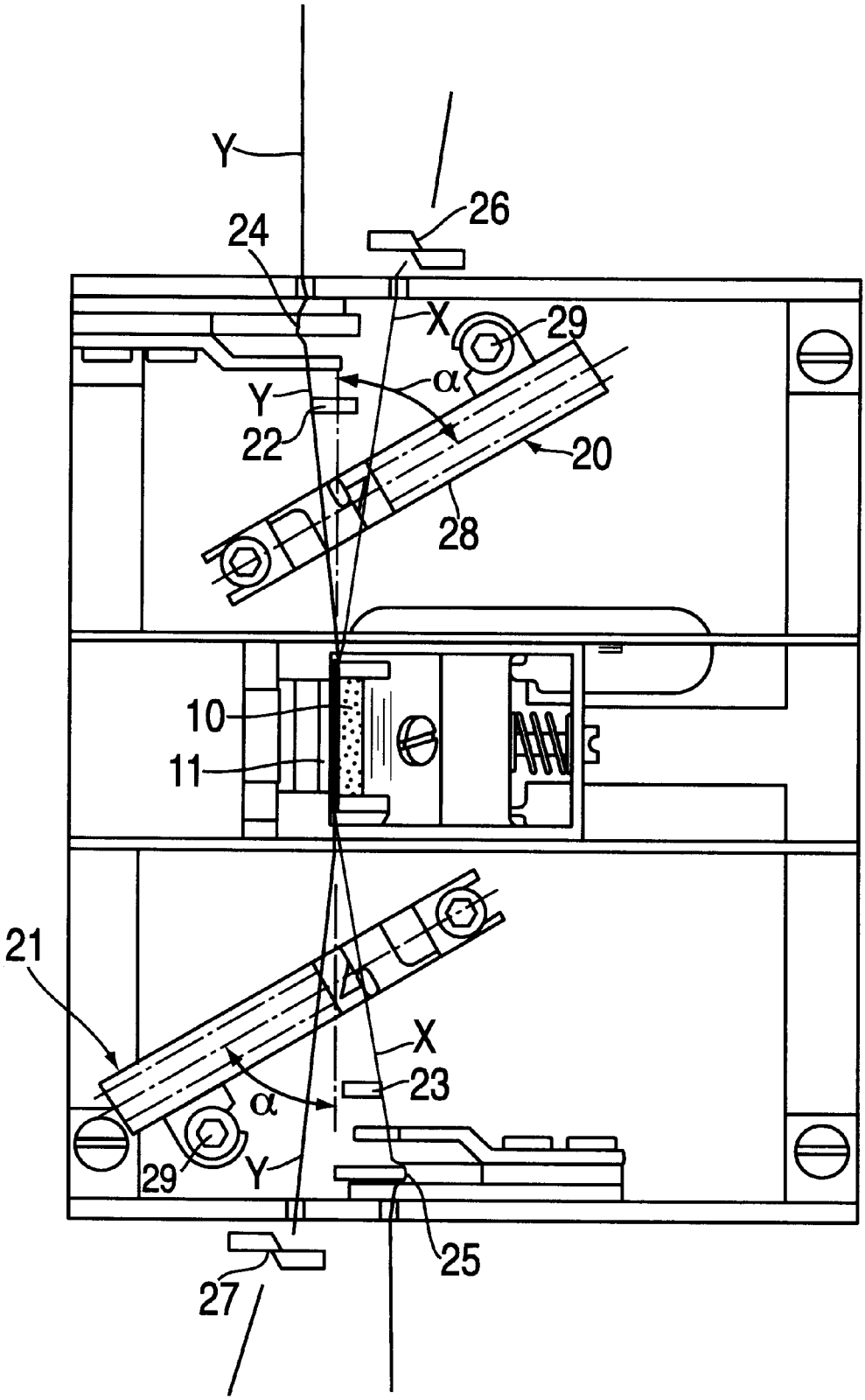

The invention will be described in greater detail below with the aid of an embodiment with reference to the accompanying drawings, in which:

FIG. 1 is a diagrammatic top view of an apparatus for the pneumatic splicing of threads on which two preparation devices according to the invention are mounted, FIG. 2 shows a cross-section through II—II of FIG. 1, FIG. 3 shows a cross-section similar to that of FIG. 2 but of a single thread end preparation device, FIG. 4 shows a cross-section through IV—IV of FIG. 3, FIGS. 5*a*–5*c* are cross-sections through V—V of FIG. 4 with the nozzle which blows the jet of fluid in three different positions of orientation about its own axis, and FIG. 6 is a diagrammatic view similar to that of FIG. 1, but with a different arrangement of the preparation devices on the splicing apparatus.

The apparatus for the pneumatic splicing of textile threads and yarns shown diagrammatically in FIG. 1 is of per se known type and so only a number of the main component parts of that apparatus are shown, such as the head 10, in which the small splicing chamber 11 is housed and on either side of which the following are arranged in succession in the case in question: devices 20 and 21 for pre-treating and preparing the ends of the two threads to be spliced, levers 22, 23 for withdrawing the prepared ends of the threads, locking devices 24, 25 for the threads which enter the splicing chamber 11 and cutting devices 26, 27 for the ends of the threads emerging from the splicing chamber 11. The ends of the threads which reach the splicing chamber are denoted by X and Y in FIG. 1 and are in one and the same plane.

An embodiment of only one of the two thread end pre-treatment devices will be described in detail below, viz. The device 20 of FIG. 1, as the other device 21 is perfectly identical. The device 20 comprises a body 28 fixed in this case with means 29 to the splicing apparatus at one side of the head 10 containing the small chamber 11. On one side the body 28 has a through hole constituting a small tube 30 for preparing a thread end, which small tube is open at its opposite ends and, in the case shown, its axis is perpendicular to the axis of the small splicing chamber 11 and is in a plane parallel to the plane in which the threads to be spliced reach the splicing chamber. At a certain distance from the hole/small tube 30 and axially aligned therewith the body 28 has a second through hole 31 which, with accurate coupling, supports a circular nozzle 32, which may be caused to rotate about the coincident axis of the nozzle and the hole 31 by means of a screwdriver which may be inserted into a slot 33 at one of its ends. The free end of the nozzle 32 opposite the hole/small tube 30 is cut obliquely with respect to the axis of the said nozzle so as to form an elliptical aperture 34 which faces the peripheral point A of the opposite inlet end 35 of the hole/small tube 30 in correspondence with which the latter is intended to receive the thread end to be treated, denoted by X in FIGS. 3–5. The cavity of the nozzle 32 is connected to a source of pressurized fluid which is not shown by means of pipes denoted diagrammatically by 36 in FIG. 3 and a shut-off element 37. In this way, with the shut-off element 37 open, a jet of pressurized fluid (usually air) is caused to emerge in correspondence with the outlet aperture 34 of the nozzle 32, the axis of which jet is diverted with respect to the axis of the nozzle 32 as a result of the oblique cut of the aperture 341 so that this diverted jet of fluid entering the opposite inlet end 35 of the small tube 30 acts in the said small tube not centrally but in a decentralized manner and may cause an effective untwisting action on the end of the thread X introduced into the treatment tube 30. The circular nozzle may be rotated and orientated in various ways about its own axis, as shown in FIGS. 5*a*–5*c*. FIG. 5*a* shows an orientation of the nozzle such that the major axis of its elliptical outlet aperture 34 is in the plane passing through the coincident axis of the tube 30 and the nozzle 32 and through the peripheral point A of the inlet end 35 of the tube 30 in correspondence with which the latter receives the end of the thread to be treated X. In this orientation position the nozzle 32 is in a neutral position and the preparation device has no preference between treating yarns having S-twist and yarns having Z-twist.

A treatment preference (untwisting) of yarns with Z-twist is obtained by rotating the nozzle 32 about its own axis from the position shown in FIG. 5*a* to the position shown in FIG. 5*b*.

In contrast, a treatment preference for yarns having S-twist is obtained by rotating the nozzle 32 in the opposite direction, i.e. from the position shown in FIG. 5*a* to the position shown in FIG. 5*c*.

By way of example the parameters of the preparation device shown in the drawings may be as follows: the proportion between the internal diameter of the nozzle 32 and the diameter of the treatment tube 30 may vary on the basis of the type of threads to be treated.

For the normal threads to be taken into account in spoolers it has been found that the diameter of the tube 30 may vary suitably from two to three times the internal diameter of the nozzle 32, where the diameter of the tube 30 must be sufficiently large to permit the entry of threads with counts up to Nm 2, but an excessive increase in the diameter of the tube would involve a loss of efficacy of the device. In practice an ideal dimension for the said diameter of the tube has proved to be between 4 and 5 mm. The length of the treatment tube 30 must not, however, be less than the length of the thread end inserted for treatment and a suitable length has been shown to be at least 30 mm. Shorter lengths involve losses of efficacy of the preparation device and a closure of the fibers at the tip of the thread end. Lengths up to 50–60 mm could also be valid, whereas although longer lengths do not appear to affect the treatment results adversely, they could create problems of application. The internal diameter of the nozzle 32 may vary from 1 to 3 mm, but with diameters close to 1 mm a net drop in the device's efficacy will be noted, whilst with diameters close to 3 mm all the other parts of the device would have to be re-dimensioned. In practice a diameter of 1.7 mm has proved to be optimum for the normal yarns to be treated and a diameter a little greater than 1.7 mm could be suitable for coarse or thermo-set yarns. The external diameter of the nozzle 32 should be as modest as possible and it is appropriate for the thickness of the wall of the nozzle 32 not to exceed 1 mm, better if it is 0.5 mm.

Characteristically according to the invention the outlet aperture 34 of the nozzle 32 is cut obliquely with respect to the axis of the said nozzle and the optimum angle of cut $\alpha$ (see FIG. 4) has proved to be 33°; good results are obtained with smaller angles and angles up to 45° are also acceptable, but a loss of efficacy is noted with angles of 60° and above.

The nozzle 32 must have a distance from the treatment tube such as to enable the thread to be treated to enter the said tube 30 with ease. Finally, the rotation of the nozzle 32 from its neutral position (FIG. 5*a*) into the positions for treating yarns with Z-twist or S-twist respectively (FIGS. 5*b* and 5*c*) may vary from 5° to 30°, and an increase in the untwisting effect is noted with an increase in the angle of rotation $\beta$ from 5° to 30°.

It is understood that the numerical values reported above should be regarded purely as a guide and in no way as binding or restrictive.

In diagrammatic form FIG. 6 shows an apparatus for splicing textile threads and yarns like the one shown in FIG. 1 but with a different arrangement on the said apparatus of the two devices for preparing the ends of the two threads to be spliced, which devices are otherwise equivalent to those described above and are also denoted by the reference numerals 20 and 21. The difference from FIG. 1 simply consists of the fact that the axis of the treatment tube 30 of the device 20, as also that of the tube of the device 21, is arranged in this case at an angle $\gamma$ which is 45° by way of example, rather than being arranged perpendicular to the axis of the small splicing chamber 11. As can be seen in FIG. 6, in this case also, before being introduced into the respective treatment tubes 30 of the preparation devices 20 and 21, the ends of the threads to be spliced X and Y pass into the free space between the inlet end 35 of the tube 30 and the elliptical aperture 34 of the nozzle 32 of the respective devices 20 and 21 so that, at the time the pressurized fluid is introduced into the nozzles 32 of the devices 20, 21, the ends of the threads X and Y may be introduced into the treatment tubes 30 to undergo preparation for splicing therein.

What is claimed is:

1. A device for preparing a thread end for splicing with an apparatus for knotless pneumatic splicing of textile threads and yarns having a splicing chamber, the device comprising:

a treatment tube, including an inlet end and a second end, the inlet end and second end being opposite one another, which is open at its opposite ends and which is suitable for receiving a thread end to be treated in correspondence at a peripheral point of the inlet end, and at a distance from and opposite said inlet end of the tube, a circular nozzle for blowing a jet of pressurized fluid the nozzle having an axis and the nozzle being axially aligned with said tube and connected by means of a shut-off element to a source of pressurized fluid, wherein the end from which the jet of fluid emerges from said nozzle is cut obliquely with respect to the axis of the nozzle so as to form an elliptical aperture, wherein the nozzle is mounted in rotatably adjustable manner about its own axis and wherein the nozzle's elliptical outlet aperture faces towards the peripheral point of the inlet end of the small tube in correspondence with which the latter receives the thread end to be treated.

2. A device according to claim 1, wherein the outlet aperture of the nozzle is cut at an angle of about 33° to 45° with respect to the axis of the nozzle.

3. A device according to claim 1, wherein in a neutral orientation position of the nozzle, the nozzle has the major axis of its elliptical outlet aperture lying in a plane passing through the common axis of the tube and the nozzle and through the peripheral point of the inlet end of the tube in correspondence with which the latter receives the thread end to be treated.

4. A device according to claim 1, wherein for the specific untwisting of yarns with Z or S-twist, the nozzle is rotated about its own axis so that the major axis of its elliptical outlet aperture is inclined by an angle of about 5° to 30° with respect to a plane passing through the common axis of the tube and the nozzle and through the peripheral point of the inlet end of the tube in correspondence with which the latter receives the thread end to be treated.

5. A device according to claim 1, comprising a body which can be fixed to the knotless pneumatic splicing apparatus at the side of the splicing chamber, wherein one side of said body has a through hole forming the treatment tube and wherein, at a distance from the treatment tube and axially aligned therewith, a second through hole formed in said body supports with accurate coupling the circular nozzle suitable for being caused to rotate about its own axis coincident with the common axis of said second through hole and the treatment tube.

* * * * *